United States Patent [19]

Luce

[11] Patent Number: 4,742,500

[45] Date of Patent: May 3, 1988

[54] STUFFED ANIMAL WITH BUILT IN TIME KEEPING DEVICE

[76] Inventor: Nunzio A. Luce, 30 Galston Dr., West Windsor, N.J. 08691

[21] Appl. No.: 14,859

[22] Filed: Feb. 13, 1987

[51] Int. Cl.[4] ..... G04B 47/00; G04B 37/00

[52] U.S. Cl. ..... 368/10; 368/276; 368/278

[58] Field of Search ..... 368/276, 278, 282, 10

[56] References Cited

U.S. PATENT DOCUMENTS

| | | | |
|---|---|---|---|
| 1,985,388 | 12/1934 | Stephans | 368/276 |
| 2,123,688 | 7/1938 | Whitehead | 368/276 |
| 3,715,882 | 2/1973 | Ohde | 368/276 |
| 4,456,384 | 6/1984 | Murakami | 368/10 |
| 4,482,256 | 11/1984 | Matsuda | 368/10 |

FOREIGN PATENT DOCUMENTS

| | | | |
|---|---|---|---|
| 119012 | 5/1926 | Switzerland | 368/278 |
| 274489 | 4/1951 | Switzerland | 368/10 |
| 474787 | 3/1969 | Switzerland | 368/278 |
| 969156 | 9/1964 | United Kingdom | 368/278 |

*Primary Examiner*—Bernard Roskoski

*Attorney, Agent, or Firm*—Cobrin & Godsberg

[57] ABSTRACT

A decorative time keeping apparatus includes a stuffed animal having an outer fabric filled with a soft stuffing material, the outer fabric formed with an opening; a hollow housing secured to the outer fabric in the opening so as to prevent escape of the stuffing, the housing including a circular recess; a clock removably secured in the recess; and a securing assembly for releasably securing the clock in the recess, the securing assembly including two diametrically opposite catches secured to the housing in the recess thereof, and two diametrically opposite latches secured to the clock and extending rearwardly therefrom for engagement by the catches, with a spring material positioned between the housing and the clock for biasing the latches into releasable locking engagement with the catches.

3 Claims, 1 Drawing Sheet

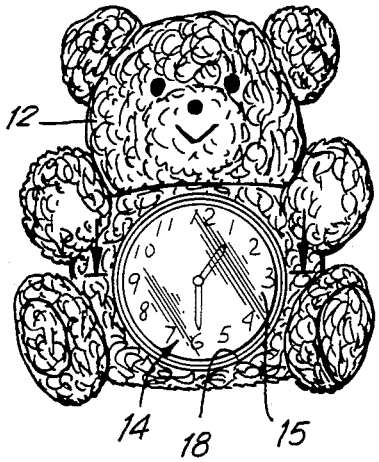
FIG. 1
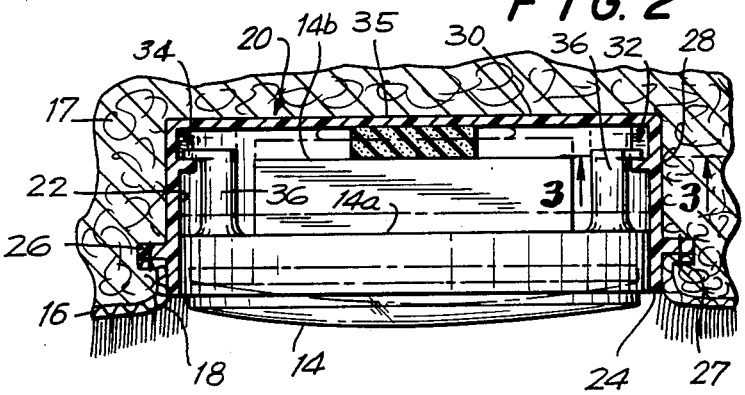
FIG. 2
FIG. 3
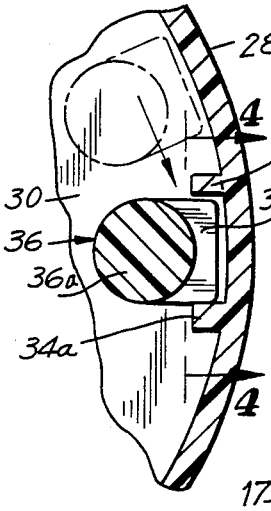
FIG. 4
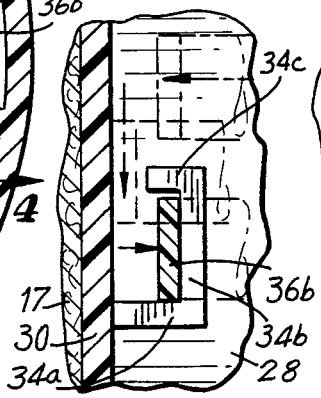
FIG. 5
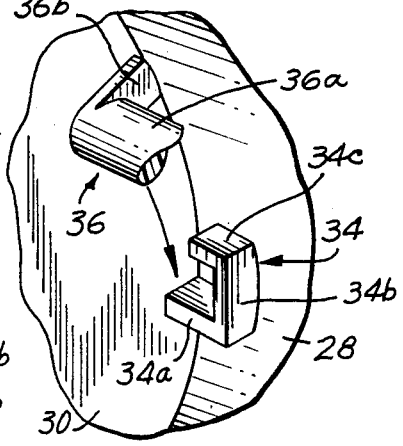

STUFFED ANIMAL WITH BUILT IN TIME KEEPING DEVICE

BACKGROUND OF THE INVENTION

The present invention relates generally to stuffed animals, and more particularly, is directed to a stuffed animal with a built in block.

Many children, and even adults, have a plurality of stuffed animals in their rooms for decorative purposes. These stuffed animals are often situated on desks, dressers and the like. Unfortunately, the stuffed animals also occupy much space, thereby taking away needed space for more essential items, such as clocks and the like.

Even if a clock could be combined with a stuffed animal, there is still the problem of securing the clock to the stuffed animal. This problem results because of the general nature of stuffed animals, that is, because stuffed animals are made of an outer fabric filled with a stuffing material, there is generally no area sufficiently rigid in which the clock can be secured in a stable manner.

Even if the clock could be secured in a stuffed animal, there would still be the problem of removing the clock from the stuffed animal to change the battery. Further, it is desirable that the various adjustment knobs on a clock which are used for setting the time, setting the alarm and the like should not be adjustable by a small child. Thus, the various knobs should be hidden from view, but adjustable by an adult. This can only be done if the clock is removably securable within the stuffed animal.

OBJECTS AND SUMMARY OF THE INVENTION

Accordingly, it is an object of the present invention to provide a stuffed animal with a built in clock.

More particularly, it is an object of the present invention to provide a stuffed animal with a clock secured thereto in a stable manner.

It is another object of the present invention to provide a stuffed animal with a built in block, in which the clock is generally protected by the stuffing in the animal.

In accordance with an aspect of the present invention, a decorative time keeping apparatus includes a stuffed animal having an outer fabric filled with a soft stuffing material, the outer fabric formed with an opening; and a clock removably secured in the opening of the animal.

The above and other objects, features and advantages of the present invention will become readily apparent from the following detailed description thereof which is to be read in connection with the accompanying drawings.

BRIEF DESCRIPTION OF THE DRAWINGS

FIG. 1 is a front elevational view of a decorative time keeping apparatus according to the present invention;

FIG. 2 is a cross-sectional view of the decorative time keeping apparatus of FIG. 1, taken along line 2—2 thereof;

FIG. 3 is a cross-sectional view of the decorative time keeping apparatus of FIG. 2, taken along line 3—3 thereof;

FIG. 4 is a cross-sectional view of the decorative time keeping apparatus of FIG. 3, taken along line 4—4 thereof; and FIG. 5 is a perspective view of a portion of the securing assembly of the decorative time keeping apparatus of FIG. 1.

DETAILED DESCRIPTION OF A PREFERRED EMBODIMENT

Referring to the drawings in detail, and initially to FIG. 1 thereof, a decorative time keeping apparatus 10 according to the present invention generally includes a stuffed animal 12 having a clock 14 removably secured therein. Although a teddy bear is shown in FIG. 1 as the stuffed animal, the present invention is not so limited, and reference to stuffed animal throughout the application is intended to take on broader significance. Therefore, stuffed animal throughout this application refers and includes other designs, such as dolls taking human form, inanimate objects and the like, which are made of an outer fabric 16 filled with a stuffing material 17.

Further, clock 14 is a conventional clock, and is formed with a front time keeping face 15, which may be analog or digital and which faces outwardly from the belly of stuffed animal 12.

As shown in FIGS. 1 and 2, the belly of teddy bear 12 is formed with a circular opening 18 in outer fabric 16, and a housing 20 having a circular recess 22 formed therein which is open at 24, is secured to fabric 16 within opening 18. More particularly, housing 20 includes an outer circumferential flange 26 which is connected to the circular side wall 28 of housing 20, and is spaced approximately one-third of the way between open end 24 and rear wall 30 of housing 20. Circumferential flange 26 is secured to the free end of fabric 16 that forms opening 18 by any suitable means, such as adhesive, and/or is secured thereto by any rope, thread, string or the like 27. In addition, fabric 16 is preferably adhered to the portion of circular side wall 28 extending between open end 24 and circumferential flange 26.

A securing assembly 32 for releasably securing clock 14 within recess 22 is shown in FIGS. 2–5. Specifically, securing assembly 32 includes two catches 34 connected to housing 20, in substantially diametrically opposite relation within recess 22 thereof. Each catch 34 has a substantially U-shape with one of its legs shorter than the other. Thus, the longer leg **34*a* of each catch 34 is connected to and extends outwardly from the inner face of rear wall 30 at a position adjacent side wall 28. The connecting leg 34*b* of each catch is connected to the upper end of longer leg 34*a* and extends transversely therefrom, while the shorter leg 34*c* of each catch 34 is connected to the opposite end of connecting leg 34*b* and extends transversely therefrom toward rear wall 30 in parallel relation to longer leg 34*a*. Because of the difference in lengths of legs 34*a* and 34*c*, shorter leg 34*a* is spaced from rear wall 30. In addition, the sides of each leg 34*a*, 34*b* and 34*c* can be connected to the inner face of circular side wall 28**.

Securing assembly 32 also includes two substantially diametrically arranged L-shaped latches 36 connected to a rear face **14*a* of clock 14 and extending rearwardly therefrom in spaced, parallel relation. Each latch 36 is formed by a post 36*a* connected to rear face 14*a* of clock 14, and a foot 36*b* connected transversely to the opposite end of post 14*a*, with foot 36*b* extending toward circular side wall 28. The distance between latches 36 is less than that between catches 34 so that latches 36 can move freely therebetween, as will be described in greater detail hereinafter. Each foot 36*b* is formed as a flat projection which extends radially outward from the respective post 36***a*, with the free end of each foot 36*b* extending substantially to side wall 28. In this manner, rotation of clock 14 with respect to housing 20 is guided by feet 36*b* against side wall 28.

Further, a spring 35 formed of rubber or other suitable resilient material is secured to a central rear face 14*b* of clock 14, as shown in FIG. 2. It will be appreciated that spring 35 could be secured to rear wall 30 as well, that is, it is only important that spring 35 be positioned between rear wall 30 and clock 14.

Thus, to releasably lock clock 14 in recess 22 of housing 20, clock 14 is positioned in recess 22 and is pushed in against the force of spring 35 to deform the same, until feet 36*b* are in contact, or substantially in contact, with the inner face of rear wall 30, as shown in dashed lines in FIG. 4. Then, clock 14 is rotated within recess 22, and thereby guided by feet 36*b* against side wall 28 of housing 20, until feet 38*b* are positioned between the respective legs 34*a* and 34*c*, and beneath the respective connecting leg 34*b*, as also shown by dashed lines in FIG. 4. It will be appreciated that legs 34*a* of catches 34 function as stops during such rotation of clock 14 in order to determine when feet 36*b* are correctly held by catches 34. Then, clock 14 is released, and spring 35 biases clock 14 outwardly, whereby feet 36*b* are positioned in biased contact with connecting legs 34*b* between legs 34*a* and 34*c*. As a result, clock 14 is restrained within housing 20. To remove clock 14, the reverse operation is performed.

While securing assembly 32 has been described as having two catches 34 and two latches 36, the present invention is not limited thereby, and any other suitable form of securing assembly 32 can be used.

It will therefore be appreciated that clock 14 is removably secured to stuffed animal 12 in a stable manner. Further, clock 14 is generally protected by the stuffing in the animal. Still further, the various adjustment knobs normally on the front face of a clock can be hidden at the side or rear of clock 14, so that they are not accessible to a small child, yet can be adjusted by an adult by removing clock 14 from the stuffed animal.

Having described a specific preferred embodiment of the invention with reference to the accompanying drawings, it will be appreciated that the present invention is not limited to that specific embodiment, and that various changes and modifications can be effected therein by one of ordinary skill in the art without departing from the scope or spirit of the invention as defined by the appended claims.

What is claimed is:

1. A decorative time keeping apparatus, comprising:

a stuffed animal having an outer fabric filled with a soft stuffing material, said outer fabric formed with an opening;

a clock removably secured in the opening of said animal;

a hollow housing fixedly secured to said outer fabric in said opening, said housing including a recess for receiving said clock, and securing means for releasably securing said clock in said recess;

said securing means including at least one catch, and said clock including at least latch releasably engagable with said at least one catch;

said recess having a substantially circular configuration; said clock including at least two substantially parallel latches extending rearwardly therefrom, each latch having a foot at a free end thereof for engagement with a respective catch;

said housing including a rear wall;

there being two catches, each catch having a long leg connected to and extending from said rear wall, a connecting leg connected to and extending transversely from a free end of said long leg, and a short leg connected to and extending from a free end of the connecting leg in substantially parallel relation to said long leg and said short leg being spaced from said rear wall;

said latches being separated by a distance less than the distance between said two catches; and there being two latches, each including a post connected to said clock and extending rearwardly therefrom, and a foot connected to a free end of said post and extending radially outward therefrom for engagement in a space defined between said long leg, short leg and connecting leg of a respective catch.

2. A decorative time keeping apparatus according to claim 1; further including spring means positioned between said clock and said rear wall for biasing each foot into engagement with a respective connecting leg when each foot is positioned in said space.

3. A decorative time keeping apparatus according to claim 1; wherein said catches are arranged in said recess in diametrically opposite relation to each other, and said latches are arranged substantially diametrically opposite each other.

* * * * *